US008245353B2

(12) United States Patent
Homner et al.

(10) Patent No.: US 8,245,353 B2
(45) Date of Patent: Aug. 21, 2012

(54) HINGE WITH TENSION-ADJUSTABLE SPIRAL TORSION SPRING

(75) Inventors: Bernhard Homner, Calw-Stammheim (DE); Dimitri Svyrsky, Pforzheim (DE); Robert Bonfert, Grafenau-Doffingen (DE)

(73) Assignee: S-Fasteners GmbH, Althengstett (DE)

( * ) Notice: Subject to any disclaimer, the term of this patent is extended or adjusted under 35 U.S.C. 154(b) by 0 days.

(21) Appl. No.: 13/116,283

(22) Filed: May 26, 2011

(65) Prior Publication Data

US 2012/0005861 A1 Jan. 12, 2012

(30) Foreign Application Priority Data

Jul. 6, 2010 (DE) ..... 20 2010 009 919 U

(51) Int. Cl.
*E05F 1/08* (2006.01)

(52) U.S. Cl. ..... 16/299; 16/54; 16/50; 16/298

(58) Field of Classification Search ..... 16/54, 55, 16/50, 298–301, 304, 307, 308
See application file for complete search history.

(56) References Cited

U.S. PATENT DOCUMENTS

| | | | | |
|---|---|---|---|---|
| 259,169 | A * | 6/1882 | Duncan | 110/306 |
| 2,072,094 | A * | 3/1937 | Bommer et al. | 16/299 |
| 2,629,881 | A * | 2/1953 | Young | 4/240 |
| 3,825,973 | A * | 7/1974 | Gwozdz | 16/300 |
| 4,339,845 | A * | 7/1982 | Newlon et al. | 16/300 |
| 4,583,262 | A * | 4/1986 | Werner | 16/300 |
| 4,696,078 | A * | 9/1987 | Stromquist | 16/301 |
| 5,048,155 | A * | 9/1991 | Hwang | 16/301 |
| 5,715,574 | A * | 2/1998 | Schall | 16/301 |
| 2003/0051313 | A1* | 3/2003 | Wu | 16/298 |
| 2004/0093689 | A1* | 5/2004 | Sosa et al. | 16/301 |
| 2006/0130276 | A1* | 6/2006 | Clark | 16/299 |
| 2007/0000090 | A1* | 1/2007 | Wu | 16/299 |

FOREIGN PATENT DOCUMENTS

| | | | |
|---|---|---|---|
| EP | 1635367 | A1 * | 3/2006 |
| EP | 0894933 | A2 | 2/2011 |

* cited by examiner

*Primary Examiner* — Chuck Y. Mah

(74) *Attorney, Agent, or Firm* — Woodling, Krost and Rust

(57) ABSTRACT

A hinge has a pivoting leaf (2) and a fixed leaf (3), a hollow axle (7) fixedly connected to the pivoting leaf and rotatably connected to first and second journal bearings (5-1, 5-2) of the fixed hinge leaf, a spiral torsion spring (8) arranged in the hollow axle. One end of the spring is fixed to the hollow axle and the other end of the spring is fixed to a worm wheel (9) that is arranged in the first journal bearing. An endless screw (6) resides in the first journal bearing and engages with the worm wheel. Rotation of the endless screw drives the worm wheel and the spiral torsion spring to rotate, thereby adjusting the tension of the spring.

7 Claims, 5 Drawing Sheets

HINGE WITH TENSION-ADJUSTABLE SPIRAL TORSION SPRING

BACKGROUND OF THE INVENTION

The invention refers to a hinge with a spiral torsion spring, whose tension is adjustable. The tension of the spring determines the self-acting spring-assisted opening of the lids on luggage boxes in aircraft, when these are fitted with hinges of this type.

The European patent application no. EP 0894 933 describes a hinge possessing the following characteristics: The hinge comprises a pivoting and a fixed hinge leaf. It has a physical hinge axle similar to a hollow cylinder which is common to both hinge leaves with an imaginary mathematical axis. The hinge axle is connected unmovably to the pivoting hinge leaf and mounted rotatably in a journal bearing. The body of the journal bearing is connected rigidly to the fixed hinge leaf. A spiral torsion spring is arranged in the hinge axle. The first of the two ends of the spiral torsion spring is anchored to the hinge axle and the second of the two ends of the spiral torsion spring is anchored permanently to the journal bearing.

The tension of the spiral torsion spring can be adjusted by moving the anchored end of the spiral torsion spring. Exact details of this design are neither stated nor implied. The purpose of the invention is to provide an arrangement which allows the tension of the spiral torsion spring to be changed at any time without having to remove and re-install the tension spring in the hinge or, in other words, to make possible to adjust the tension of the spiral torsion spring simply by operating a setting element, The worm-type gear unit according to the invention already known in the art and consists of a screw-shaped so-called endless screw (shaft) which, when it rotates, turns a gear wheel (worm wheel) engaging the shaft. The axes of the endless screw and the worm wheel are offset by 90° with reference to one another.

BREIF DESCRIPTION OF THE DRAWINGS

One example of the invention is shown in the drawings and is described below in greater detail.

FIG. 1 shows an isometric diagram of the hinge according to the invention shown from the outside showing the pivoting and the fixed hinge leaf which is connected rigidly with the journal-bearing body of the journal bearing for a hollow-cylinder-like hinge axle (not shown in this view) common to both hinge leaves, and showing a setting element for a worm-gear unit for setting the tension of a spiral torsion spring arranged in the axle of the hinge.

DETAILED DESCRIPTION OF THE PREFFERED EMBODIMENTS

Figure 1:
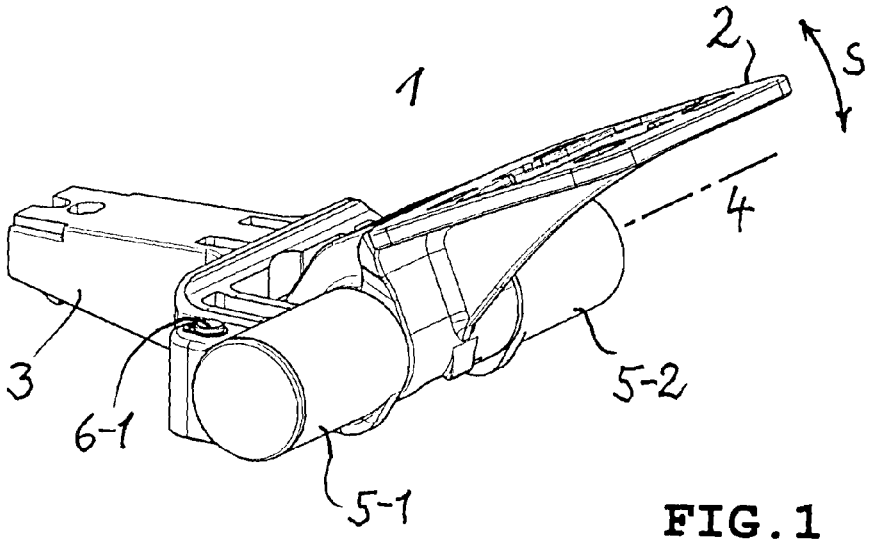

FIG. 1 shows an isometric diagram of the hinge according to the invention viewed towards hinge leaf 2 which can be pivoted in direction S around an imaginary mathematical axis 4, and towards the fixed hinge leaf 3. The fixed hinge leaf 3 is connected rigidly with the journal-bearing body of the journal bearing 5-1, 5-2 for a physical hinge axle (not shown in this view) (see FIGS. 2 and 3). This has a form similar to a hollow cylinder. This hinge axle is common to both hinge leaves 2, 3. A setting element 6-1 for a worm-gear unit (not shown in this view) is arranged adjacent to the journal bearing 5-1. The worm-gear unit is for setting the tension of a spiral torsion spring arranged in the axle of the hinge.

Figure 2:
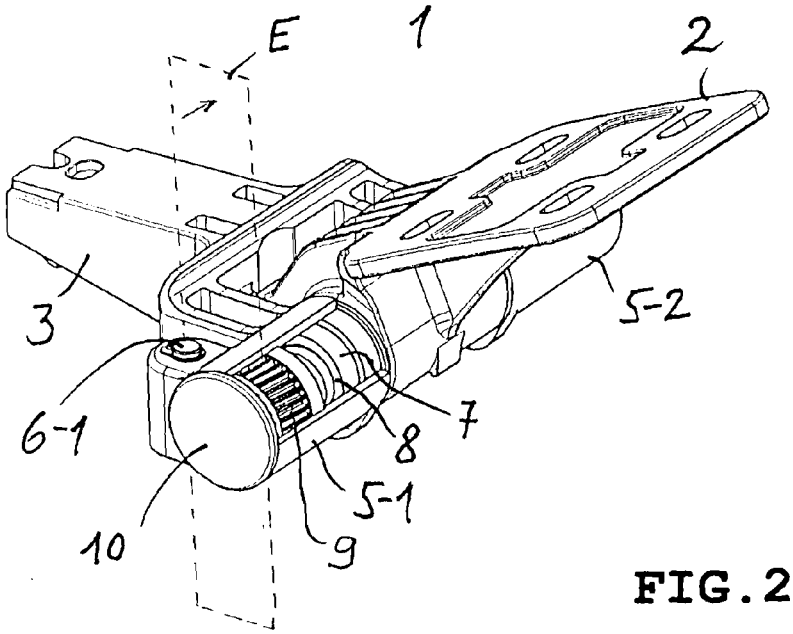
FIG. 2 shows an isometric diagram of the hinge according to the invention according to FIG. 1 with the journal bearing opened to show the hinge axle, the spiral torsion spring and the worm wheel of the worm-type gear unit.

FIG. 2 shows an isometric diagram of the hinge according to the invention according to FIG. 1 with the journal bearing 5-1 opened to show the hinge axle 7, the spiral torsion spring 8 and the worm wheel 9 of the worm-type gear unit.

Figure 3:
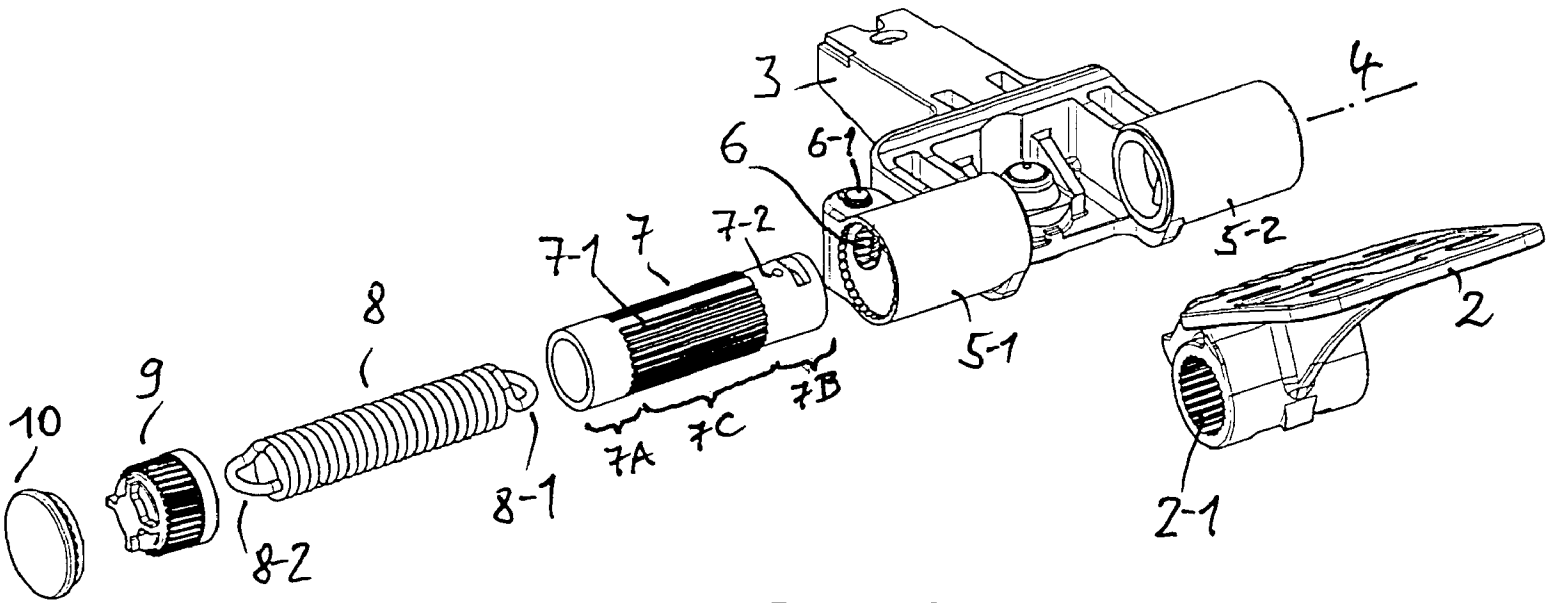
FIG. 3 shows an exploded diagram of the hinge according to the invention with an isometric representation of the individual components.

FIG. 3 shows an exploded diagram of the hinge according to the invention with an isometric representation of the individual components: the moving leaf 2 of the hinge, the fixed leaf 3 of the hinge, which is connected rigidly with the journal-bearing body of the journal bearing 5-1, 5-2, the hollow-cylinder-like physical hinge axis 7 common to both leaves 2, 3 of the hinge with imaginary mathematical axis 4. In its centre area 7C, the hinge axle 7 is fitted positively to hinge leaf 2 with reference to the pivoting direction S. The hinge leaf 2 has a through opening 2-1 aligned with axis 4, through which the hinge axle 7 can be pushed. The opening 2-1 is formed in such a way that a positive fit exists between it and the area 7C of the hinge axle 7, so that turning the hinge axle 7 causes the hinge leaf 2 to pivot. To achieve such an interlocking positive connection, the hinge axis 7 can, for example (as shown in FIG. 3) have interlocking tooth grooves in area 7C and on the inside of the opening 2-1 of the moving hinge leaf 2. Other types of positive connection are also possible, e.g. when the hinge axle (in the sectional view vertical to axis 4) is hexagonal in shape in area 7C and the through opening 2-1 (in the sectional view vertical to axis 4) is also hexagonal in shape.

Figure 4:
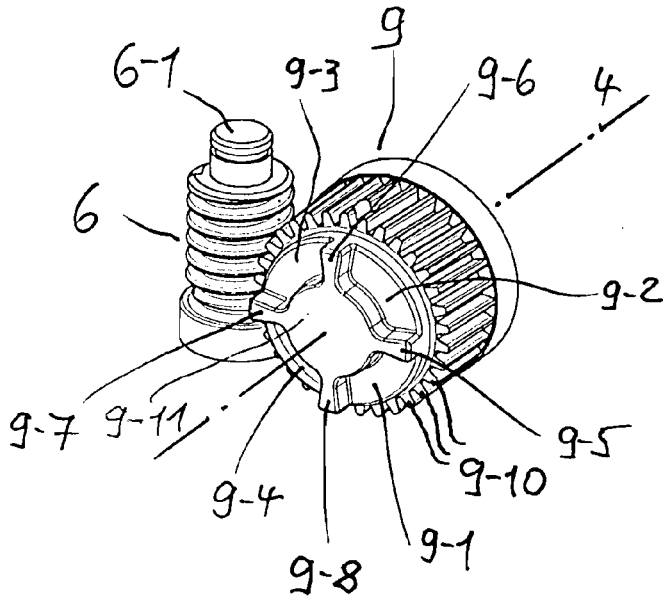
FIG. 4 shows an isometric diagram of the worm-gear unit of the hinge according to the invention.
Figure 8:
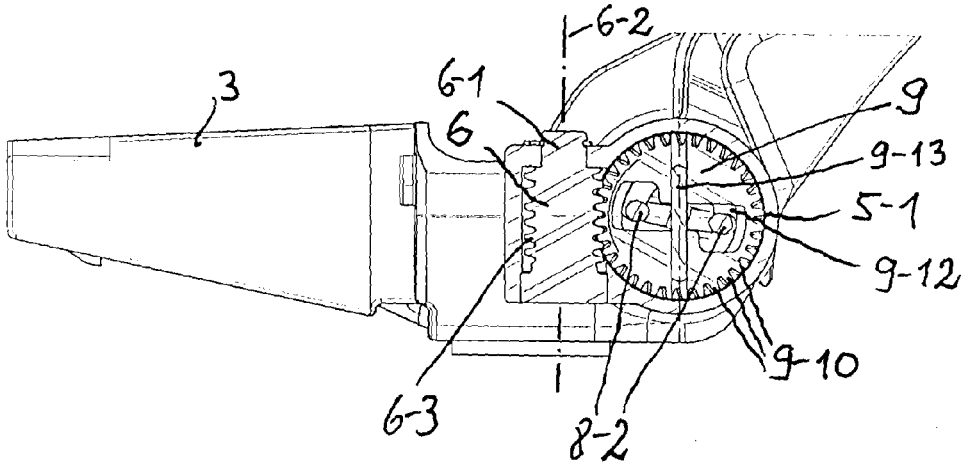
FIG. 8 shows a sectional view of the worm-gear unit according to cutting plane E in FIG. 2.

FIG. 4 shows an isometric diagram of the worm-gear unit of the hinge according to the invention. The worm-gear unit consists of the worm wheel 9 and the endless screw 6. As seen in FIG. 2 and FIG. 8, the worm wheel 9 is arranged in the journal bearing 5-1 to rotate around the mathematical axis 4 of the hinge axle 7. The worm wheel 9 is fixed permanently to the second 8-2 of the two ends of the spiral torsion spring. This means that this end 8-2 rotates with the worm wheel 9 when this 9 is adjusted via the screw 6.

As shown in FIG. 2, the endless screw 6 is arranged in the fixed journal-bearing body of the journal bearing. It is mounted on bearings at both ends.

It engages the teeth 9-10 of the worm wheel 9 and can be adjusted by means of the setting element 6-1. The setting element 6-1 may, for example, have a slot (not shown) to permit adjustment using a screwdriver. When the endless screw 6 is adjusted (turned), the worm wheel 9 is also turned correspondingly. In this way it is possible to vary the tension of the spiral torsion spring 8.

Figure 5:
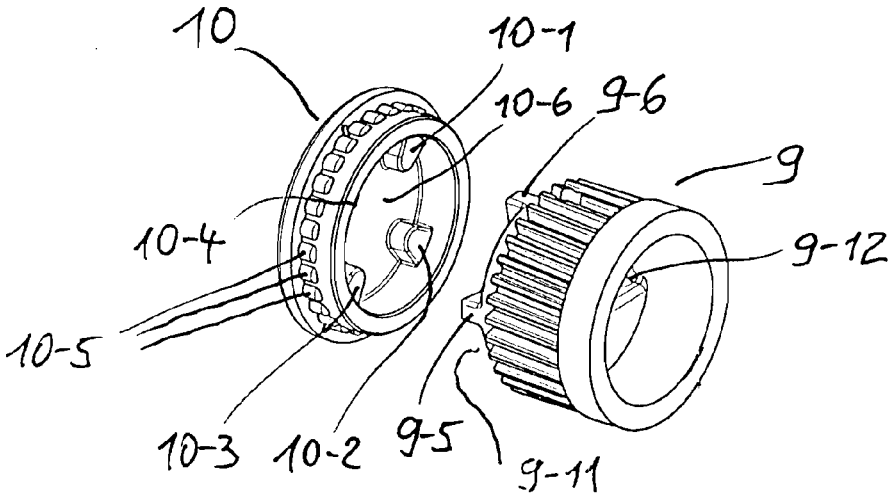
FIG. 5 shows an isometric diagram of the worm wheel and the closing element for the journal bearing.

The range of rotation of the worm wheel 9 is limited. FIGS. 4 and 5 show the design features of the opposing sides of the worm wheel 9 and the closing element 10 which are necessary to achieve this limitation in the range of rotation.

FIG. 5 shows an isometric diagram of the worm wheel 9 and the closing element 10 for the journal bearing 5-1.

On the side 9-11 of the worm wheel 9 facing the closing element 10, limiting elements 9-6, 9-7 are arranged which delimit the sector 9-3 of a circle on side 9-11 corresponding to the limited turning range with reference to the axis 4. Opposite this side 9-11 on side 10-6 of the closing element 10, a stop element 10-1 is arranged. When the worm wheel 9 is turned to its maximum extent within the sector 9-3 of the circle, its limiting elements 9-6, 9-7 strike against the stop element 10-1.

In addition, several circle sectors 9-2, 9-3, 9-4, 9-1 corresponding to the limited turning range are defined on side 9-11 of the worm wheel 9, which are delimited by the limiting elements 9-5, 9-6, 9-7, 9-8. The 4 circle sectors, are positioned in groups of two facing one another across the circle.

On the side 10-6 of the closing element 10, several stop elements 10-1, 10-2, 10-3, 10-4 are provided of which each is assigned to one sector 9-3, 9-4, 9-1, 9-2 of the circle. This results in a simultaneous limitation of the turning range at four different places.

It would also be possible to define two, three or five etc. sectors on the side 9-11.

As stated above, the ends 8-1 and 8-2 of the spiral torsion spring 8 are fixed permanently to the hinge axle 7 and to the worm wheel 9.

Figure 6:
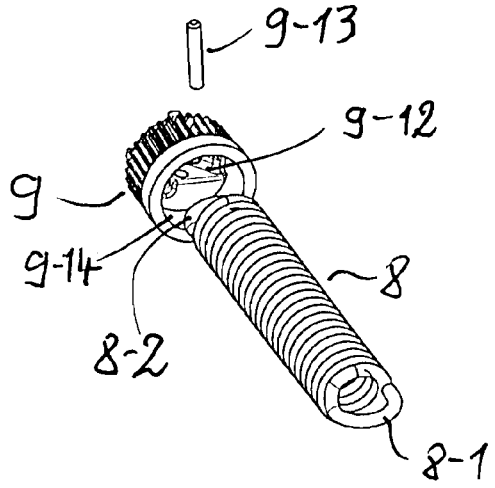
FIG. 6 shows a diagram for the attachment of one end of the spiral torsion spring to the worm wheel.

FIG. 6 shows a diagram for the attachment of the end 8-2 of the spiral torsion spring 8 to the worm wheel 9. Both ends 8-1, 8-2 are bent to form a semi-circle. On the side of the worm wheel 9 facing the spiral torsion spring 8 a recess 9-14 is provided whose base has a slot-shaped recess 9-12 to receive the end 8-2 of the spiral torsion spring. The end 8-2 is fixed in the slot 9-12 by a pin 9-13 which is arranged in the worm wheel 9, in the slot 9-12 and in the semi-circular end 8-2 of the spring 8 in such a way (see FIG. 8) that the spring 8 can not be pulled out of the slot towards the axle.

The end 8-1 of the spring is secured to the hinge axle 7 (FIG. 3) by a pin and slot in the same way as described above for the end 8-2. The semi-circularly bent end of the spring 8-1 is inserted into a slot in the interior of the hinge axle (not shown). In FIG. 3, only the upper opening 7-2 in the area 7B of the hinge axle is shown, into which the pin is inserted in such a way that it passes through the semi circle of the spring end 8-1 to ensure that that the spring 8 can not be pulled out of the slot towards the axle.

Figure 7:
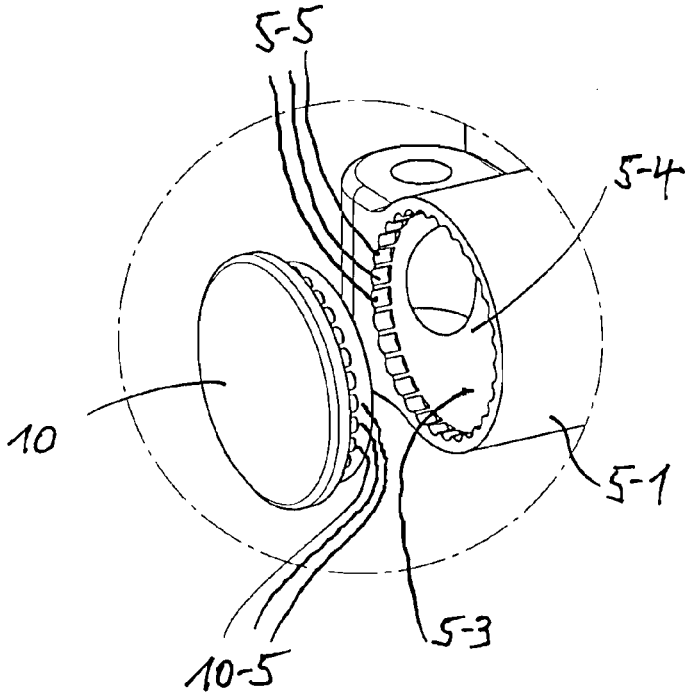
FIG. 7 shows a diagram for the attachment of the closing element to the journal bearing.

FIG. 7 shows an isometric diagram of the worm wheel 9 and the closing element 10 for the journal bearing 5-1. The journal bearing 5-1 (FIG. 7) is a through bore 5-3, through whose outer opening 5-4 the hinge axle 7 with the spiral torsion spring 8 and the worm wheel 9 are pushed during assembly. This opening 5-4 is then closed by the closing element 10.

On the closing element 10, tappet-like elements 10-5 are arranged concentrically. Corresponding recesses 5-5 for the insertion of these tappet-like elements 10-5 are provided on the edge of the opening 5-4 of the bore 5-3.

The position for insertion of the closing element 10 can be selected.

FIG. 8 shows a sectional view of the worm-gear unit (6,9) corresponding to cutting plane E in FIG. 2. The endless screw 6 is arranged in the journal-bearing body of the journal bearing 5-1. The body of the journal bearing is connected rigidly with the fixed leaf 3 of the hinge. A stated above, the endless screw 6 can be adjusted, i.e. turned around its own axis 6-2 by means of the manually operating setting element 6-1. Its shaft 6-3 engages the teeth 9-10 of the worm wheel 9. Turning the endless screw 6 causes the worm wheel 9 to rotate around the axis 4.

This in turn causes the spiral torsion spring 8 to turn, one of whose ends 8-1 is connected to the hinge axle 7 and the other end 8-2 to the worm wheel 9.

The slot for receiving the semi-circularly shaped end 8-2 of the spring 8 is indicated as 9-12 and the securing pin as 9-13.

Turning the screw 6 thus causes the worm wheel 9 to turn, thereby varying the tension of the spiral torsion spring 8. Using the setting element 6-1 therefore permits adjustment of the spiral torsion spring without removing and re-installing the spiral torsion spring in the hinge axle, thereby meeting the requirements of daily practice.

The invention claimed is:

1. A hinge (1), comprising:

a pivoting hinge leaf (2) and a fixed hinge leaf (3);

a hollow hinge axle (7) common to said pivoting hinge leaf and said fixed hinge leaf;

a first journal bearing and a second journal bearing, said first journal bearing includes a first journal bearing body, and, said second journal bearing includes a second journal bearing body;

said hollow hinge axle includes an axis (4), said hollow hinge axle (7) connected unmovably to said pivoting hinge leaf (2) and mounted rotatably on said first and second journal bearings (5-1, 5-2);

said first journal bearing body of said first journal bearing and said second journal bearing body of said second journal bearing are rigidly connected with said fixed (3) hinge leaf;

a spiral torsion spring (8) residing in said hollow hinge axle (7);

said spiral torsion spring includes a first end (8-1) and a second end (8-2);

said first (8-1) end of said spiral torsion spring (8) is connected unmovably to said hinge axle (7);

a worm-gear unit includes a worm wheel (9) and an endless screw (6), said endless screw (6) resides in said first journal bearing body of said first journal bearing (5-1), and, said worm wheel includes teeth (9-10);

said second (8-2) end of said spiral torsion spring is connected to said worm wheel;

said endless screw (6) drives said worm wheel;

said second (8-2) end of said spiral torsion spring (8) rotates with said worm wheel;

said worm wheel (9) in said first journal bearing (5-1) rotates around said axis (4) of said hinge axle (7) and is unmovably fixed to said second (8-2) end of said spiral torsion spring (8);

said teeth of said worm wheel interengage said endless screw (6), and, rotation of said endless screw rotatably drives said worm wheel (9) and said spiral torsion spring adjusting tension of said spiral torsion spring (8).

2. A hinge according to claim 1, wherein said worm wheel is rotatable in a range of rotation and said range of rotation is limited.

3. A hinge according to claim 2 further comprising:

a closing element (10);

said first journal bearing (5-1) includes a through bore (5-3) and said through bore includes an opening (5-4), said opening residing distally away from said moving hinge leaf (2), said through bore and said opening receiving one end (7A) of said hinge axle (7) and receiving said worm wheel (9); and, said opening (5-4) of said first journal bearing is closed by said closing element (10).

4. A hinge according to claim 3, wherein: said closing element includes concentric tappet-like elements (10-5); said opening (5-4) of said through bore (5-3) includes edge recesses (5-5); said tappet-like elements (10-5) therein engage said edge recesses (5-5).

5. A hinge according to claim 4, wherein said closing element is positionable within said opening (5-4).

6. a hinge according to claim 3, wherein:

said worm wheel includes limiting elements (9-6, 9-7) said limiting elements delimit at least one sector (9-3) of a circle corresponding to said limited range of rotation of said worm wheel;

said closing element includes at least one stop element (10-1);

said limiting elements of said worm wheel engage said stop element of said closing element when said worm wheel (9) is turned to its maximum extent within said sector of said circle (9-3).

7. A hinge according to claim 6, wherein said worm wheel (9) includes a plurality of sectors (9-2, 9-3, 9-4, 9-1) corresponding to said limited turning range delimited by limiting elements (9-5, 9-6, 9-7, 9-8) and that said closing element (10) includes a plurality of stop elements (10-1, 10-2, 10-3, 10-4) corresponding to said a plurality of sectors (9-3, 9-4, 9-1, 9-2).

* * * * *

UNITED STATES PATENT AND TRADEMARK OFFICE

CERTIFICATE OF CORRECTION

PATENT NO. : 8,245,353 B2
APPLICATION NO. : 13/116283
DATED : August 21, 2012
INVENTOR(S) : Homner et al.

It is certified that error appears in the above-identified patent and that said Letters Patent is hereby corrected as shown below:

In column 1, line 31 after “make” insert -- it --.

In column 1, line 34 after “invention” insert -- is --.

Signed and Sealed this
Second Day of October, 2012

David J. Kappos

David J. Kappos
*Director of the United States Patent and Trademark Office*